United States Patent [19]

Reynolds

[11] Patent Number: 4,967,508

[45] Date of Patent: Nov. 6, 1990

[54] TREE STAND

[76] Inventor: Arthur A. Reynolds, 722 Wetherborn Pl., Stone Mountain, Ga. 30083

[21] Appl. No.: 434,856

[22] Filed: Nov. 7, 1989

[51] Int. Cl.[5] ..... A47G 33/12

[52] U.S. Cl. ..... 47/40.5; 248/523

[58] Field of Search ..... 47/39, 40.5; 248/524, 248/525, 526, 527, 523, 519

[56] References Cited

U.S. PATENT DOCUMENTS

| | | | |
|---|---|---|---|
| 1,644,807 | 10/1927 | Ziegler | 248/526 |
| 1,721,980 | 7/1929 | Wardell | 47/40.5 |
| 2,755,050 | 7/1956 | Ford | 47/40.5 |
| 2,899,156 | 8/1959 | Marcucci | 47/40.5 X |
| 2,903,212 | 9/1959 | Scanland | 47/40.5 X |
| 2,904,291 | 9/1959 | Harbes | 248/524 X |
| 3,272,462 | 9/1966 | Apple | 248/523 X |
| 3,350,043 | 10/1967 | Apple | 47/40.5 |
| 3,526,379 | 10/1970 | Schwaderlapp | 47/40.5 |
| 3,801,053 | 4/1974 | Laute | 248/524 X |
| 4,585,201 | 4/1986 | Pursell | 248/524 X |
| 4,825,586 | 5/1989 | Coppedge | 248/523 X |

FOREIGN PATENT DOCUMENTS

| | | | |
|---|---|---|---|
| 33213 | 7/1912 | Sweden | 47/40.5 |
| 488751 | 6/1938 | United Kingdom | 47/47 |

*Primary Examiner*—Henry E. Raduazo
*Assistant Examiner*—Jerrold D. Johnson
*Attorney, Agent, or Firm*—James B. Middleton

[57] ABSTRACT

A tree stand supports either a real, live tree or an artificial tree such as a Christmas tree or other decorative tree. The tree stand includes a container for holding a quantity of liquid nutrient for the tree, the container having a horizontal platform fixed therein to receive the lower end of the tree. A screw threadedly engages the bottom of the container; and, the screw is reversible to present either end upwardly for engaging the tree. One end of the screw is a wood screw for use with a real tree, and the other end is a frustoconical member for engaging the tubular post of an artificial tree. The screw includes a gasket for sealing the container when used for a live tree.

9 Claims, 2 Drawing Sheets

TREE STAND

INFORMATION DISCLOSURE STATEMENT

The prior art includes numerous stands, or holding devices, for supporting trees such as Christmas trees. These prior art stands frequently include a projecting member to be received by the tree in an effort to hold the base of the tree in the desired position. Some of the prior art stands also include a container for receiving liquids such as water. Such a container is desirable when a live tree is to be displayed since the presence of water or other nutrient liquid prevents rapid drying of the tree both to preserve the appearance of the tree and to diminish the fire hazard of a dry tree with the very flammable needles.

Currently, artificial trees are very common. With respect to Christmas trees, one person might use a live tree in one year, and use an artificial tree in a subsequent year. The prior art does not include a stand particularly adaptable for use with either a live tree or an artificial tree, so such a person might well require two different tree stands. Also, when a live tree is utilized with a liquid, the prior art has not provided any simple means for handling the liquid when the tree is to be removed.

SUMMARY OF THE INVENTION

This invention relates generally to tree stands and the like, and is more particularly concerned with an improved stand for supporting selectively a live tree and an artificial tree, either tree being held firmly by the stand.

The present invention provides a tree stand including a container for receiving a quantity of liquid, the container including a plurality of legs for supporting the container. Centrally, the container includes a horizontal platform for receiving the base of a tree to be held by the tree stand. Reversible screw means will selectively provide a wood screw thread for engaging a tree, and provide a frusto-conical member for receiving the cylindrical base of an artificial tree. When the screw means is positioned to hold a live tree, the screw means further provide a water tight seal for the container.

In the preferred embodiment, the container includes a drain having a flexible tubing provided for ease in draining liquid from the container.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENT

Figure 1:
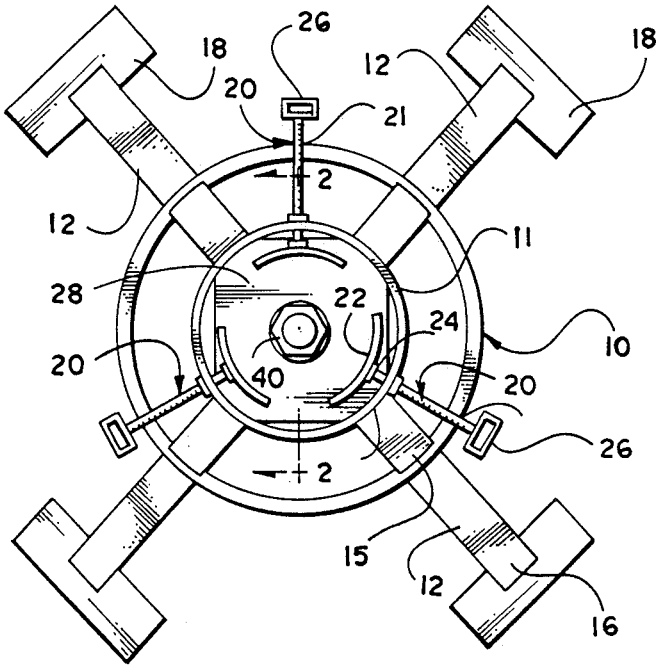
FIG. 1 is a top plan view showing a tree stand made in accordance with the present invention.

Referring now more particularly to the drawings, and to that embodiment of the invention here presented by way of illustration, the tree stand shown in FIG. 1 of the drawings includes a container 10, and a ring 11 supported above the container 10, and concentrically therewith. A plurality of legs 12 support the container 10 above the floor or other surface, and also support the ring 11 above the container 10. Each of the legs 12 is attached to the ring 11 at the innermost end 14. The leg 12 then slopes outwardly and downwardly to pass through the container 10 at 15; and, the leg 12 continues to slope outwardly and downwardly to its outermost end 16. The end 16 is provided with a foot 18. The foot 18 is here shown as an enlarged rectangular pad, but it will be understood that any means for providing the foot 18 will suffice. The object of the feet 18 is to provide better stability of the tree stand when the tree stand is utilized on carpeting or the like.

As here shown, the tree stand includes four legs 12. All of the legs 12 are identical, all carry the same reference numerals, and the above description will not be repeated.

The ring 11 is supported above the container 10, and provides a collar for giving lateral support to the tree above the base of the tree. The collar, or ring, 11 carries three adjustable stops designated at 20. Each of the three stops 20 is alike, so only one will be described in detail. The stop 20 includes a threaded shaft 21 having a pad 22 at its innermost end. It is contemplated that the fitting 24 between the screw 21 and the pad 22 will be a ball and socket arrangement to allow universal motion between the pad 22 and the screw 21. Those skilled in the art are familiar with such mechanical arrangements, and no further detail is considered necessary. The ring 11 includes a threaded boss 25 for receiving the screw 21. If the ring 11 is thick enough material to provide adequate threads, the boss 25 can be omitted. Finally, the outermost end of the screw 21 carries a flattened portion 26.

Considering these three stops 20, it will be seen that the three stops are distributed around the ring 11 equidistantly. Thus, when a tree is received in the tree stand, the individual stops 20 can be adjusted as appropriate to hold the tree precisely vertically. The pads 22 are sufficient to support the tree without damaging a live tree or denting or otherwise harming an artificial tree trunk.

Figure 2:
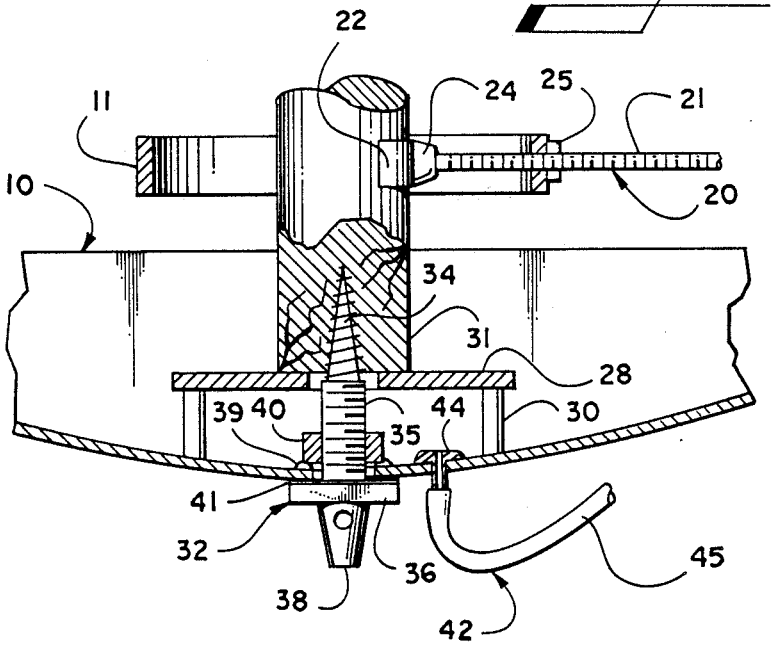
FIG. 2 is an enlarged cross-sectional view taken substantially along the line 2—2 in FIG. 1, and showing the screw means adapted for holding a live tree.

Centrally of the container 10, there is a platform 28 to receive and support the lowermost end of the tree. This is better shown in FIG. 2 of the drawings where it will be seen that the container 10 has a curved bottom 29. The platform 28 is supported above the bottom 29 on a plurality of stanchions 30, and the platform 28 is substantially horizontal. The platform 28 therefore provides a proper resting place for the end of the tree which is shown in FIG. 2 at 31.

To assure that the tree 31 is firmly fixed to the platform 28, there is a screw means generally designated at 32. It will be noted that the screw means 32 is a composite having a conventional tapered, wood screw thread 34 at its uppermost end, and a machine screw thread 35 fixed to the wood screw 34. Adjacent to the machine screw 35, there is a head member 36; and, fixed to the head member 36 and axially aligned with the screws 34 and 35, there is a frusto-conical member 38.

The container 10 has a hole 39 in the center of the bottom 29. As here shown, a nut 40 is fixed in place over the hole 39 as by welding or the like. Thus, the screw means 32 can be passed upwardly through the hole 39 in the container 10, the wood screw 34 being small enough to slide through the hole 39 and through the nut 40. The nut 40 has a thread that is complementary to the thread on the machine screw 35 so the two members will be threadedly engaged. The result is that the screw member 32 will be engaged with the container 10, and the wood screw 34 will enter the tree trunk 31 and urge the tree trunk 31 downwardly towards the platform 28. Since the machine screw 35 stops short of the upper surface of the platform 28, it will be understood that the wood screw 34 will pull the tree trunk 31 snugly against the platform 28.

The head member 36 is large enough to cover the hole 39 in the bottom 29, and there is a gasket 41 the effect a good seal between the head member 36 and the bottom 29. This allows the container 10 to be filled with liquid without the danger of leakage.

It will be readily recognized that the water or other nutrient liquid in the container 10 must be removed when the tree is to be taken down; however, such trees are normally displayed in living rooms or family rooms where there is no ready access to drain lines. For convenience in emptying the container 10, the tree stand of the present invention includes a drain line 42. The drain line 42 includes a fitting 44 that passes through the bottom 29 of the container 10, the fitting 44 being welded, soldered, or otherwise fixed in the container to prevent leakage. A tubing 45 then fits over the fitting 44. With this arrangement, the flexible tube 45 can be carried upwardly and clamped at the top of the container 10. As long as the extending end of the tube 45 is above the liquid level within the container 10, it will be understood that there will be no leakage. When the container 10 is to be emptied, the tube 45 will be released from the clamp, and lowered to allow the liquid to drain into an appropriate container or the like.

Figure 3:
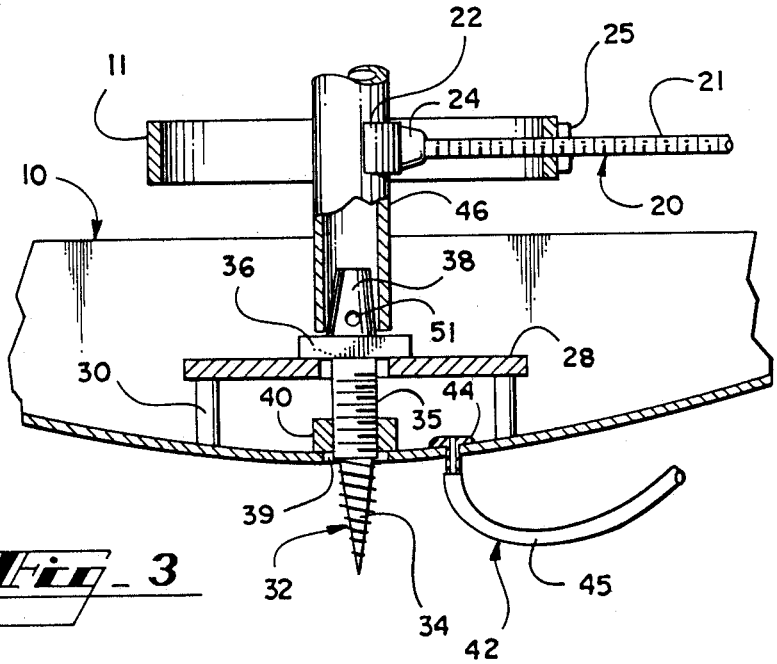
FIG. 3 is a view similar to FIG. 2 but showing the screw means arranged for holding an artificial tree; and, FIG. 4 is an enlarged side elevational view showing the screw means illustrated in FIGS. 2 and 3.

Attention is next directed to FIG. 3 of the drawings. It will be noted that FIG. 3 is very similar to FIG. 2, but the screw means 32 is reversed. In FIG. 3 it will be seen that the tree trunk designated at 46 is for an artificial tree, and comprises simply a piece of tubing. The tubing 46 therefore slips over the frusto-conical member 38. The member 38 preferably has a base diameter larger than the inside diameter of the tubing 46, thereby assuring lateral stability of the tubing 46 with respect to the member 38. Since the member 38 is frustoconical, it will be understood that a single member will support a wide variety of sizes of artificial tree trunks 46.

The screw device as used in FIG. 3 of the drawings is threaded from within the container 10, downwardly so the machine screw 35 will engage the nut 40. The wood screw 34 simply extends through the bottom of the container 10. The screw means 32 is therefore stably attached to the container 10, and can hold the artificial tree trunk 46. While the drain line 42 is shown in place in FIG. 3, it will be understood that the container 10 would not be filled with water so the drain line is not needed, but it does not detract from use of the stand for an artificial tree.

Figure 4:
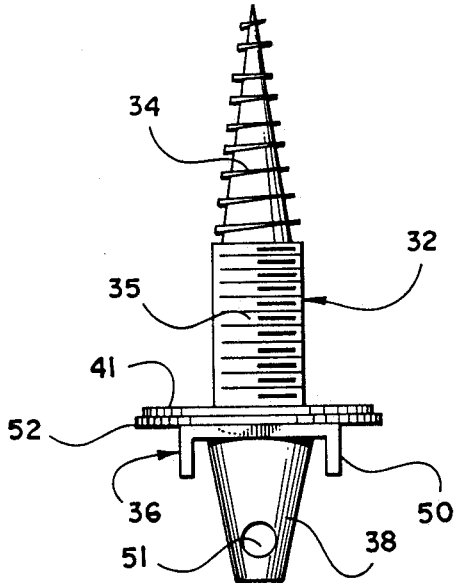

Attention is now directed to FIG. 4 of the drawings which shows the screw means 32 in more detail. In FIG. 4 it is clearly shown that the wood screw 34 is of a smaller diameter than the machine screw 35. Since the wood screw 34 must pass through the nut 40 it will be understood that the major diameter of the wood screw 34 must be less than the minor diameter of the machine screw 35. The two screws 34 and 35 are concentric so there is no wobble as the wood screw engages the tree trunk 31 while the machine screw 35 engages the nut 40.

The head member 36 is conveniently formed by a channel member which provides flat sides 50 for use as a thumb screw or to receive a wrench. Also, the frusto-conical member 38 defines holes 51 to receive a rod member in the event additional leverage is required.

The head member 36 may be relatively narrow in one direction, as illustrated in FIG. 4, so a washer 52 or the like may be provided against the head 36. The washer 52 then acts as a backup for the gasket 41 to urge the gasket 41 securely against the bottom 29.

From the foregoing description, operation of the device should be understandable. In the event a person is to erect a live tree, the stops 20 will be manipulated to provide a sufficiently open space where the tree trunk 31 can be passed through the ring 11, in the middle of the three stops 20. The tree trunk 31 will extend downwardly to abut the plate 28. The screw means 32 will then be engaged with the nut 40; and, continued rotation of the screw means 32 will urge the screw means 32 upwardly towards the tree trunk 31, and cause the wood screw 34 to enter the tree trunk 31. At the end of possible rotation of the screw means 32, the tree trunk 31 will be held snugly against the platform 28, and the gasket 41 will be held snugly against the bottom 29 of the container 10. With the trunk 31 held securely at its lowermost end, the various screws 21 will be manipulated to urge the pads 22 against the tree trunk to provide lateral support. The tree with the stand can then be placed as desired, and the feet 18 will provide good support, even on deep pile carpets or the like. Once the tree is in place the container 10 can be appropriately filled with water or other nutrients.

When the tree is to be taken down, one might first release the tube 45 from its clip and lower the tube to allow water to drain from the container 10. After the water has been drained, the screw means 32 can be unscrewed to release the tree trunk 31, the screws 21 backed off somewhat, and the tree removed from the stand.

For an artificial tree, the screw means 32 will first be placed in the container as shown in FIG. 3 of the drawings. The tree trunk 46 will then be placed over the frusto conical member 38, and the stops 20 appropriately adjusted to hold the trunk 46 substantially vertically.

It will of course be understood by those skilled in the art that the particular embodiment of the invention here presented is by way of illustration only, and is meant to be in no way restrictive; therefore, numerous changes and modifications may be made, and the full use of equivalents resorted to, without departing from the spirit or the scope of the invention as outlined in the appended claims.

I claim:

1. A tree stand for supporting a tree for display, said tree stand including a container, said container including a concave bottom, a plurality of legs for supporting said container from a surface, a collar above said container and fixed with respect thereto, a horizontal platform within said container and sized and adapted to receive the entire bottom surface of the lower end of said tree thereon, means for supporting said platform from said concave bottom, and screw means selectively engageable with said container, said screw means including a machine screw for threaded engagement with said container, and tree engaging means coaxial with said machine screw, said platform defining an opening therethrough for receiving said screw means, said machine screw being below said platform and said tree engaging means being above said platform for engaging said lower end of said tree.

2. A tree stand as claimed in claim 1, said concave bottom defining a hole coaxial with said opening in said platform, and including a nut concentric with said hole for threadedly engaging said machine screw.

3. A tree stand as claimed in claim 2, and further including a plurality of feet, each foot of said plurality of feet being fixed to one leg of said plurality of legs, said feet comprising enlarged pads for providing a stable foundation for said tree stand.

4. A tree stand as claimed in claim 2, and further including a plurality of stops carried by said collar, each stop of said plurality of stops including a pad, and a screw carrying said pad, said screw being threadedly engaged with said collar.

5. A tree stand as claimed in claim 2, and further including drain means for said container, and flexible tube means communicating with said drain means for selectively draining said container.

6. A tree stand as claimed in claim 2, said tree engaging means comprising a frustonical member, said screw means further including a head means on said machine screw, said frustonical member being fixed to said head means coaxially with said frustonical member, the arrangement being such that said head means engages said platform while said machine screw passes through said hole and engages said nut, and said lower end of said tree is received over said frustoconical member.

7. A tree stand as claimed in claim 2, said screw means further including a wood screw fixed coaxially to said machine screw, head means fixed to one end of said machine screw, said wood screw being fixed to the opposite end of said machine screw, the arrangement being such that said screw means can selectively pass upwardly through said hole so that said machine screw engages said nut while said head means engages said bottom of said container and said wood screw threadedly engages said lower end of said tree, and pass downwardly through said opening in said platform so that said machine screw engages said nut while said head means engages said platform and said lower end of said tree engages said frustoconical member.

8. A tree stand as claimed in claim 2, said tree engaging means comprising a wood screw, said screw means further including a head means on said machine screw, the arrangement being such that said head means engages said bottom of said container while said machine screw passes through said hole and engages said nut, and said wood screw threadedly engages said lower end of said tree.

9. A tree stand as claimed in claim 8, said head member being large enough to cover said hole in said bottom of said container, and further including gasket means between said head member and said bottom of said container for rendering said container liquid tight.

* * * * *